United States Patent [19]

Lojko et al.

[11] Patent Number: 4,653,679

[45] Date of Patent: Mar. 31, 1987

[54] SHOE OFF AID

[76] Inventors: Jozef Lojko; Jan Lojko, both of 101 Nassau Ave., Brooklyn, N.Y. 11222

[21] Appl. No.: 835,621

[22] Filed: Mar. 3, 1986

[51] Int. Cl.[4] ..... A47G 25/80

[52] U.S. Cl. ..... 223/115

[58] Field of Search ..... 223/113, 114, 115, 116, 223/117

[56] References Cited

U.S. PATENT DOCUMENTS

| | | | |
|---|---|---|---|
| 1,893,280 | 1/1933 | Gerfen | 223/115 |
| 2,571,447 | 10/1951 | Hilton | 223/115 |
| 4,226,346 | 10/1980 | Turner | 223/115 |

*Primary Examiner*—Louis K. Rimrodt
*Assistant Examiner*—Joseph S. Machuga
*Attorney, Agent, or Firm*—Richard L. Miller

[57] ABSTRACT

A shoe remover that is collapsible to become compact and is truly portable. It has a front portion with a recess and a cushion to prevent marring of the shoe. A rear portion is pivotally mounted, by a hinge, to the rear edge of the front portion and an elevation portion is pivotally mounted, by a hinge, to the underside of the front portion and biased in the extended position by a spring so that the front portion and the extended rear portion assume the shape of an inclined plane.

1 Claim, 4 Drawing Figures

SHOE OFF AID

BACKGROUND OF THE INVENTION

This application is a substitute application for Ser. No. 06/661,130, filed Oct. 15, 1984, which is now abandoned.

The present invention relates to a shoe remover. More particularly, it relates to a shoe remover that contains a recess for receiving the rear part of the shoe to be removed.

Shoe removers of the above-mentioned general type are known in the art. For example, U.S. Pat. No. 2,525,174 to Johnstone teaches a combined bootjack and mud scraper. Another example, U.S. Pat. No. 3,526,346 to Drouillard et al. teaches a boot puller. A final example, U.S. Pat. No. 3,784,067 to Hicks teaches a boot jack.

The above-mentioned show removers share the same common disadvantage. They are not collapsible and cannot therefore be made compact to be truly portable.

SUMMARY OF THE INVENTION

It is the primary object of the present invention to provide a shoe remover which avoids the disadvantages of the prior art.

It is another object of the present invention to provide a shoe remover which is collapsible, so as to become compact and be truly portable.

It is still another object of the present invention to provide a shoe remover that has a cushion placed in the shoe receiving recess to prevent marring of the shoe.

It is a final feature of the present invention to provide a shoe remover which is collapsible by means of hinges.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENT

Figure 1:
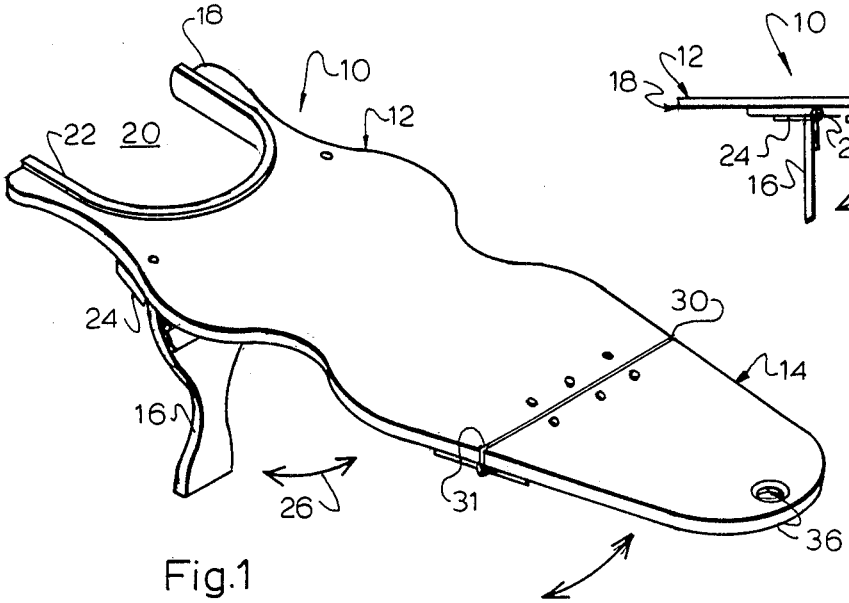
FIG. 1 is a perspective view of the invention.

Referring now to the Figures, the shoe off aid of the present invention is shown generally at 10 and has a front portion 12, a rear portion 14, and a elevation portion 16.

The front portion 12 is flat and has a front edge 18 that contains a recess 20. The recess 20 is fitted with a cushion 22 to protect a shoe from marring.

Figure 3:
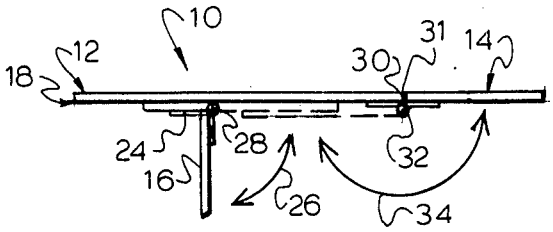
FIG. 3 is a side view of the invention per se.

The elevation portion 16 (see FIG. 3) is pivotally mounted to the underside of the front portion 12 and allows the front portion 12 to achieve the position of an inclined plane. The elevation portion 16 is pivoted by means of a hinge 24 in the directions of arrows 26 and is biased in the extended position by a spring 28.

The rear portion 14 is flat and has a front edge 31 that is pivotally mounted to rear edge 30 of the front portion 12. The rear portion 14 is pivoted by means of a hinge

Figure 2:
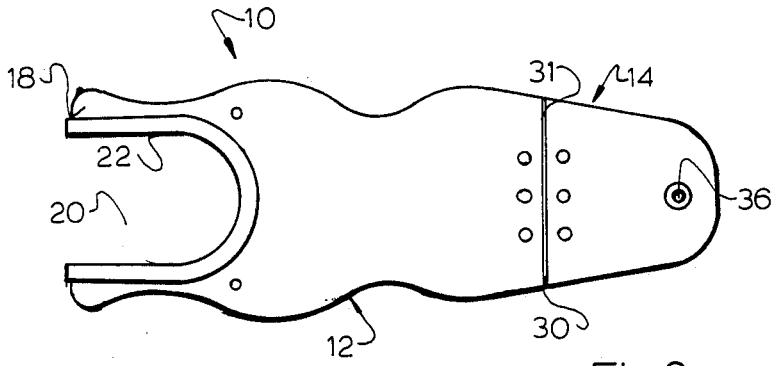
FIG. 2 is a top view of the invention.

32 in the directions of arrows 34. In the vicinity of the rear edge of the rear portion 14, is disposed a throughbore 36 for hanging up the shoe off aid 10 during storage (See FIGS. 1 and 2).

Figure 4:
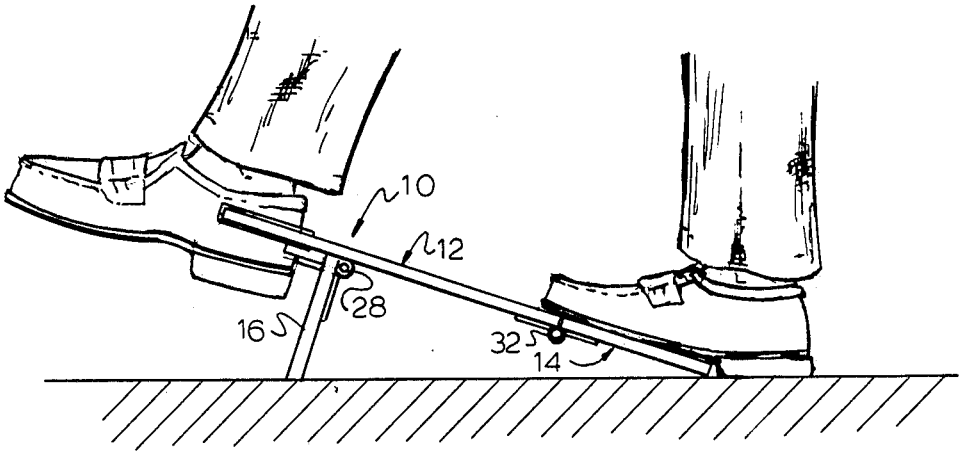
FIG. 4 is a side view of the invention shown in use.

In operation, as shown in FIG. 4, the rear portion 14 is extended so as to lie in the same plane as the front portion 12 and the elevation portion 16 is extended and assumes a position which is substantially perpendicular to the plane of the front and rear portions 12 and 14. The user, places one foot on the top surfaces of the front and rear portions 12 and 14 over the region of the hinge 32 so as to prevent the shoe off aid 10 from moving while keeping the rear portion 14 coplanar with the front portion 12 and the elevation portion 16 perpendicular to the front portion 12 and on the ground. The user then places his other foot into the recess 20 in the front portion 12 so that the rear of the shoe rests against the cushion 22. In this position the user merely lifts his leg and the shoe will be retained in the recess 20 and be removed from the user's foot. The other shoe is removed in a likewise manner by reversing the positions of the user's feet.

Because the elevation and rear portions 16 and 14, respectively are hingingly attached they can be folded towards each other and rest on the underside of the front portion 12. The collapsibility of the elevation and rear portions 16 and 14, respectively, against the underside of the front portion 12, allows a portable compact shoe off aid 10 to be achieved.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

We claim:

1. A shoe remover, for a shoe having a rear part comprising:

a front poriton lying in a plane and having an underside, a rear edge and a front edge containing a recess adaptable for receiving the rear part of the shoe;

a rear portion having an underside, a front edge pivotally mounted with a first hinge to said rear edge of said front portion and being movable from a collapsed position with the two undersides confronting and said rear portion facing toward the front, to an extended position and vise versa, so that when said rear portion is in said extended position said rear portion lies in a plane that is coplaner with said plane that said front portion lies in; and an elevation portion having a top edge, a second hinge pivotally mounting said top edge to said underside of said front portion and spaced forwardly from said first hinged, said elevation portion being movable from a collapsed portion against the underside of the front portion and facing toward the rear portion, to an extended position and vise versa so that when said elevation portion is in said extended position said elevation portion lies in a plane that is substantially perpendicular to said plane that said front portion lies in, and spring means for biasing said elevation portion in its extended position, said rear portion in its collapsed position facing forward and overlying said rearward facing elevation portion in its collapsed position for acting against the biasing spring to maintain the elevation portion collapsed.

* * * * *